US006984137B2

(12) United States Patent
Akasaka et al.

(10) Patent No.: US 6,984,137 B2
(45) Date of Patent: Jan. 10, 2006

(54) ELECTRICAL CONNECTOR AND ELECTRICAL CONNECTOR ASSEMBLY

(75) Inventors: Junya Akasaka, Kanagawa (JP); Izumi Hasegawa, Kanagawa (JP)

(73) Assignee: Tyco Electronics AMP K.K., Kanagawa-Ken (JP)

( * ) Notice: Subject to any disclaimer, the term of this patent is extended or adjusted under 35 U.S.C. 154(b) by 0 days.

(21) Appl. No.: 11/018,021

(22) Filed: Dec. 21, 2004

(65) Prior Publication Data

US 2005/0142909 A1 Jun. 30, 2005

(30) Foreign Application Priority Data

Dec. 25, 2003 (JP) ..... 2003-430610

(51) Int. Cl.
*H01R 13/648* (2006.01)

(52) U.S. Cl. ..... 439/108

(58) Field of Classification Search ..... 439/108, 439/660, 609
See application file for complete search history.

(56) References Cited

U.S. PATENT DOCUMENTS

| | | | | |
|---|---|---|---|---|
| 5,277,597 | A * | 1/1994 | Masami et al. | 439/83 |
| 5,411,404 | A * | 5/1995 | Korsunsky et al. | 439/108 |
| 5,413,491 | A * | 5/1995 | Noschese | 439/108 |
| 5,536,179 | A * | 7/1996 | Olsson et al. | 439/108 |
| 5,542,851 | A * | 8/1996 | Chikano | 439/108 |
| 5,618,191 | A * | 4/1997 | Chikano et al. | 439/108 |
| 5,813,871 | A * | 9/1998 | Grabbe et al. | 439/108 |
| 5,860,814 | A * | 1/1999 | Akama et al. | 439/74 |
| 5,915,976 | A * | 6/1999 | McHugh | 439/74 |
| 5,921,787 | A * | 7/1999 | Pope et al. | 439/74 |
| 5,993,257 | A * | 11/1999 | Maruyama | 439/607 |
| 6,015,304 | A * | 1/2000 | Yagi et al. | 439/108 |
| 6,019,616 | A * | 2/2000 | Yagi et al. | 439/108 |
| 6,056,560 | A | 5/2000 | Wu et al. | |
| 6,080,016 | A * | 6/2000 | Ho et al. | 439/607 |
| 6,089,883 | A * | 7/2000 | McHugh et al. | 439/108 |
| 6,250,935 | B1 * | 6/2001 | Mochizuki et al. | 439/74 |
| 6,290,515 | B1 * | 9/2001 | Lee | 439/108 |
| 6,338,635 | B1 * | 1/2002 | Lee | 439/108 |
| 6,390,833 | B1 * | 5/2002 | Chang | 439/108 |
| 6,503,101 | B1 * | 1/2003 | Yu | 439/607 |
| 6,572,410 | B1 | 6/2003 | Volstorf et al. | |
| 6,648,657 | B1 * | 11/2003 | Korsunsky et al. | 439/108 |
| 6,663,402 | B1 * | 12/2003 | Yu | 439/108 |

(Continued)

FOREIGN PATENT DOCUMENTS

| | | |
|---|---|---|
| JP | 05-135826 | 6/1993 |

(Continued)

*Primary Examiner*—Ross Gushi
(74) *Attorney, Agent, or Firm*—Barley Snyder LLC

(57) ABSTRACT

The invention provides an electrical connector assembly that is constituted by a first connector and a second connector, each of the first and second connectors having signal contacts disposed in two rows, a grounding member disposed between the rows of signal contacts and a housing that holds the signal contacts and the grounding member and being engaged with each other, and an electrical connector that constitutes the electrical connector assembly. The electrical connector and electrical connector assembly increase the reliability of a grounding path, require only a small number of component parts and are suitable for high-speed signal transmission. A first grounding plate and a second grounding plate that constitute the grounding member are disposed in the immediate vicinity of rows of signal contacts that are disposed in two rows and the housing has a through opening. Therefore, a connection section that constitutes the grounding member can be visually checked.

3 Claims, 9 Drawing Sheets

U.S. PATENT DOCUMENTS

| | | | | |
|---|---|---|---|---|
| 6,672,887 | B1 * | 1/2004 | Yu | 439/108 |
| 6,685,485 | B2 * | 2/2004 | Korsunsky et al. | 439/79 |
| 6,688,897 | B2 * | 2/2004 | Korsunsky et al. | 439/108 |
| 6,726,492 | B1 * | 4/2004 | Yu | 439/108 |
| 6,884,094 | B1 * | 4/2005 | Bernhart et al. | 439/101 |
| 2002/0028592 | A1 * | 3/2002 | Lee | 439/108 |
| 2002/0115318 | A1 * | 8/2002 | Apicelli | 439/108 |
| 2003/0171015 | A1 * | 9/2003 | Korsunsky et al. | 439/108 |
| 2003/0176110 | A1 * | 9/2003 | Wu et al. | 439/660 |
| 2005/0032434 | A1 * | 2/2005 | Zhang et al. | 439/660 |
| 2005/0142922 | A1 * | 6/2005 | Akasaka et al. | 439/346 |

FOREIGN PATENT DOCUMENTS

| | | |
|---|---|---|
| JP | 2000-516028 | 11/2000 |
| WO | WO 98/05099 | 2/1998 |

* cited by examiner

ELECTRICAL CONNECTOR AND ELECTRICAL CONNECTOR ASSEMBLY

FIELD OF THE INVENTION

The present invention relates to an electrical connector assembly that is constituted by a first connector and a second connector, each of the first and second connectors having signal contacts disposed in two rows, a grounding member disposed between the rows of signal contacts and a housing that holds the signal contacts and the grounding member and being engaged with each other, and an electrical connector that constitutes the electrical connector assembly.

BACKGROUND

In recent years, the speed of signals has become more and more high and electrical connectors also have been required to provide structures suited to the transmission of higher speed signals.

In performing high-speed signal transmission, grounding plays an important role and what grounding parts should be disposed in what places is important. The reliability of connection is also important, for example, when grounding parts are connected to a substrate.

FIG. 8 is a sectional view of an electrical connector assembly disclosed in the Japanese Patent Laid-Open No. 5-135826.

An electrical connector assembly 80 shown in this FIG. 8 is constituted by a first electrical connector 81 and a second electrical connector 82 that are engaged with each other. The first electrical connector 81 has signal contacts 811 disposed in two rows, a grounding member 812 disposed between the rows of the signal contacts 811, and a housing 813 that holds the signal contacts 811 and the grounding member 812. The signal contacts 811 and the grounding member 812 have what is called dip type leg sections 811*a,* 812*a* that pierce through a substrate (not shown).

Similarly, the second electrical connector 82 also has signal contacts 821 disposed in two rows, a grounding member 822 disposed between the rows of the signal contacts 821, and a housing 823 that holds the signal contacts 821 and the grounding member 822. The signal contacts 821 and the grounding member 822 have what is called dip type leg sections 821*a,* 822*a* that pierce through a substrate (not shown).

FIG. 9 is an appearance perspective view of an electrical connector assembly disclosed in the National Publication of International Patent Application No. 2000-516028, and FIG. 10 is a drawing that shows the arrangement of contacts that constitute the electrical connector the appearance of which is shown in FIG. 9.

This electrical connector 90 has four rows of contacts 91, 92, and a housing 93 that holds these four rows of contacts 91, 92. In this housing 93, between the inner two rows of contacts 92 among these four rows of contacts 91, 92 there is formed an opening 931 to which leg sections 92*a* of these inner two rows of contacts 92 are exposed.

In the case of the electrical connector assembly 80 of FIG. 8 disclosed in the Japanese Patent Laid-Open No. 5-135826, the grounding members 812, 822 are disposed between the rows of signal contacts 811, 821 of the electrical connectors 81, 82, and therefore, in this respect, crosstalks of the signal contacts 811, 821 are reduced, providing a structure suitable for high-speed signal transmission. However, in the case of the electrical connector assembly 80 shown in this FIG. 8, both the signal contacts 821 and the grounding member 822 have the dip type leg sections 821*a,* 822*a* that pierce through the substrate and, therefore, this poses the problems that (1) the solder connection cannot be visually checked from the top surface side of the substrate and (2) because the leg sections 822*a* of the grounding member 822 are spaced from each other, it is difficult to minimize the length of a grounding path.

On the other hand, in the case of the electrical connector disclosed in the National Publication of International Patent Application No. 2000-516028 shown in FIGS. 9 and 10, the contacts 92 of the inner two rows are not grounding contacts and hence are not suitable for high-speed signal transmission. Furthermore, each of the contacts 92 is independent, posing the problem that the number of component parts becomes very large.

SUMMARY

In view of the above circumstances, the invention provides an electrical connector and an electrical connector assembly that has increased reliability of grounding paths and a small number of component parts and are suitable for high-speed signal transmission.

The electrical connector of the present invention includes: signal contacts disposed in two rows; a grounding member disposed between the rows of the signal contacts; and a housing that holds the signal contacts and the grounding member, wherein the grounding member comprises a first grounding plate disposed in the immediate vicinity of one signal contact row, a second grounding plate disposed in the immediate vicinity of the other signal contact row, and a connection section that connects the first and second grounding plates together and is surface mounted on a substrate on which the electrical connector is mounted, the grounding member being in the form of the letter Π as viewed from the side, and wherein the housing has a through opening between the first and second grounding plates so that the connection section can be visually checked.

Also, an electrical connector assembly of the present invention includes: a first connector and a second connector, each of the first and second connectors having signal contacts disposed in two rows, a grounding member disposed between the rows of signal contacts and a housing that holds the signal contacts and grounding member and being engaged with each other, wherein each of the grounding components comprises a first grounding plate disposed in the immediate vicinity of one signal contact row, a second grounding plate disposed in the immediate vicinity of the other signal contact row, and a connection section that connects the first and second grounding plates together and is surface mounted on a substrate on which the electrical connector is mounted, the grounding members being in the form of the letter Π as viewed from the side, and wherein each of the housings has a through opening between the first and second grounding plates so that the connection section can be visually checked.

It is preferred that in the above electrical connector assembly of the invention, the grounding plate of the first connector be positioned inward compared to the grounding plate of the second connector and has relatively large rigidity.

According to the above electrical connector or electrical connector assembly of the invention, because the first and second grounding plates that constitute the grounding member are disposed each in the immediate vicinity of each row of signal contacts that are disposed in two rows, the electrical connector or electrical connector assembly is suitable for high-speed signal transmission. Also, because the housing has a through opening and the connection section that constitutes the grounding member can be visually checked, the condition of the solder joining of the connection section can be visually checked and the reliability of a grounding path is improved. Furthermore, the grounding member may be a one-piece member that is in the form of the letter Π as viewed from the side, which reduces the number of component parts.

When the grounding plate of the first connector is positioned inward compared to the grounding plate of the second connector and has relatively large rigidity, a housing wall is unnecessary on the inner side of the grounding plate of the first connector, with the result that it is possible to maintain the size of the electrical connector assembly in the width direction without impairing the ease of visual check of the connection section.

DETAILED DESCRIPTION OF THE EMBODIMENT(S)

Embodiments of the invention will be described below.

Figure 1:
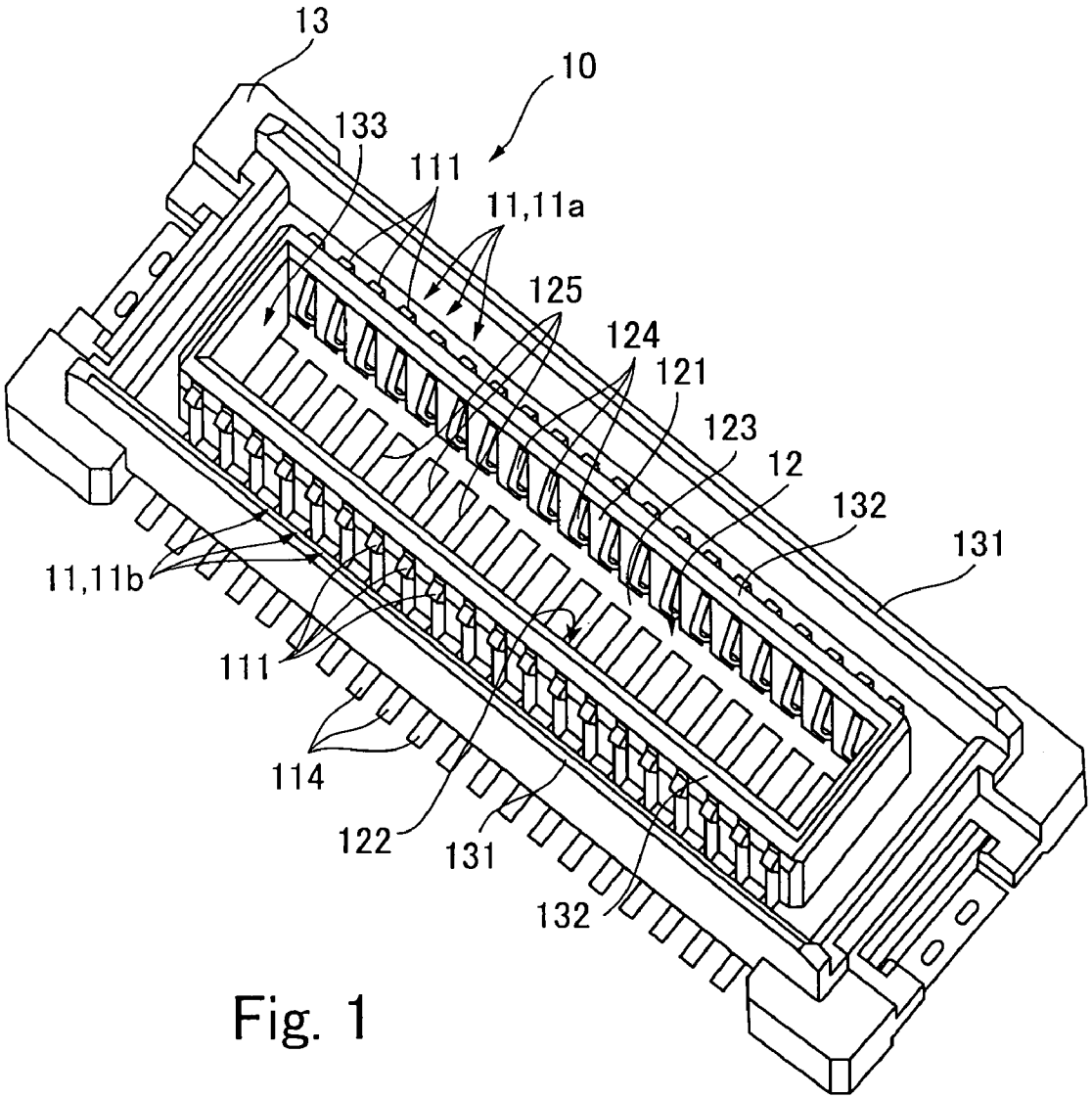
FIG. 1 is a perspective view of a plug connector that constitutes an electrical connector assembly in an embodiment of the invention.
Figure 2:
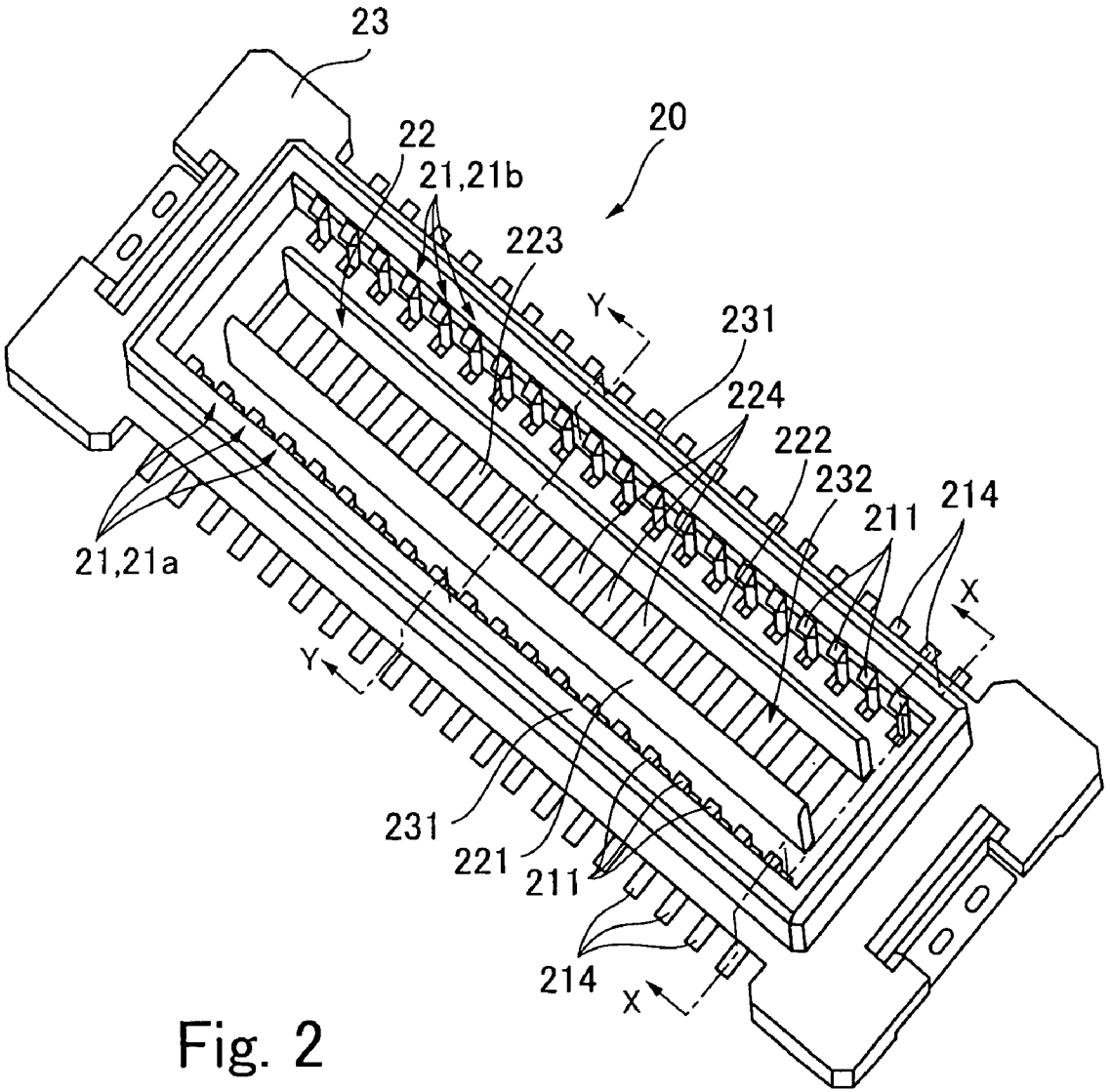
FIG. 2 is a perspective view of a receptacle connector that constitutes an electrical connector assembly in an embodiment of the invention.

FIGS. 1 and 2 are perspective views of a plug connector and a receptacle connector, respectively, that constitute an electrical connector assembly in an embodiment of the invention. The plug connector and the receptacle connector are each an embodiment of an electrical connector of the invention.

A plug connector 10 shown in FIG. 1 is constituted by signal contacts 11 disposed in two rows, a grounding member 12 that is in the form of the letter Π as viewed from the side, and a housing 13 that holds the signal contacts 11 and the grounding member 12.

The housing 13 has an outer wall 131 that covers the outer circumference of the housing and an inner wall 132 provided in a standing manner on the inner side of the outer wall along the outer wall, and on the inner side of the inner wall 132 a large through opening 133 is formed.

Each of the signal contacts 11 has, as parts shown in FIG. 1, a contact section 111 that comes into contact with the contact of the mating connector, the contact section rising along the outer side of the inner wall 132 of the housing 13, and a terminal section 114 connected to a substrate (not shown), the terminal section extending laterally from the bottom of the housing 13 and projecting from the housing 13. The detailed structure of the signal contacts 11 will be described later.

The grounding member 12 comprises a first grounding plate 121 disposed in the immediate vicinity of one signal contact row 11*a* among the signal contacts 11 disposed in two rows, a second grounding plate 122 disposed in the immediate vicinity of the other signal contact row 11*b*, and a connection section 123 that connects the first grounding plate 121 and the second grounding plate 122 together and is surface mounted on a substrate (not shown here, refer to FIG. 3) on which the plug connector 10 is mounted. Grounding contacts 124 formed by blanking and bending are arranged in the first grounding plate 121 and second grounding plate 122 of this grounding member 12. In the connection section 123 of this grounding member 12 there are provided many slit-like openings 125 that pierce through the rear surface of this plug connector 10. This grounding member 12 is held by the housing 13 in such a manner that the connection section 123 of the grounding member is disposed in the through opening 133 of the housing 13 and that the first grounding plate 121 and second grounding plate 222 are held on the inner side of the inner wall 132 of the housing 13.

A receptacle connector 20 shown in FIG. 2 is constituted by signal contacts 21 disposed in two rows, a grounding member 22 that is in the form of the letter Π as viewed from the side, and a housing 23 that holds the signal contacts 21 and the grounding member 22.

In the housing 23, an outer wall 231 that covers the outer circumference of the housing is formed and in the middle of a region enclosed by the outer wall 231 there is formed a through opening 232 that extends in the longitudinal direction.

Each of the signal contacts 21 of this receptacle connector 20 has, as parts shown in FIG. 2, a contact section 211 that comes into contact with the contact of the mating connector, the contact section rising along the inner side of the outer wall 231 of the housing 23, and a terminal section 214 connected to a substrate (not shown), the terminal section extending laterally from the bottom of the housing 23 and projecting from the housing 23. The contact section 211 of this signal contact 21 has the same shape as the contact section 111 of the signal contact 11 of the plug connector 10 shown in FIG. 1. The detailed structure of the signal contact 21 will be described later along with the description of the detailed structure of the signal contact 11 of the plug connector 10 shown in FIG. 1.

The grounding member 22 comprises a first grounding plate 221 disposed in the immediate vicinity of one signal contact row 21*a* among the signal contacts 21 disposed in two rows, a second grounding plate 222 disposed in the immediate vicinity of the other signal contact row 21*b*, and a connection section 223 that connects the first grounding plate 221 and the second grounding plate 222 together and is surface mounted on a substrate (not shown here, refer to FIG. 3) on which this receptacle connector 20 is mounted.

The first grounding plate 121 and second grounding plate 122 that constitute the grounding member 12 of the plug connector 10 shown in FIG. 1 are supported by the inner wall 132 of the housing 13 and, therefore, the grounding member 12 of this plug connector 10 is formed from a thin plate material, whereas the first grounding plate 221 and second grounding plate 222 that constitute the grounding member 22 of the receptacle connector 20 shown in FIG. 2 are provided in a standing manner by the rigidity of the grounding plates themselves. Therefore, the grounding member 22 of this receptacle connector 20 is formed from a thick plate material compared to the grounding member 12 of the plug connector 10 shown in FIG. 1 and has relatively large rigidity.

Thus, because the grounding member 22 of this receptacle connector 20 has rigidity large enough to enable the grounding member 22 to stand itself, it is unnecessary to form a wall to support the first grounding plate 221 and second grounding plate 222 that constitute the grounding member 22 in the housing 23 of this receptacle connector 20. As a result of this, it is possible to minimize the size of the electrical connector assembly constituted by this receptacle connector 20 and the plug connector 10 in the width direction and to keep the visibility of the connection sections 123, 223 in a good condition.

In the connection section 223 of the grounding member 22 that constitutes the receptacle connector 20 shown in FIG. 2 there are formed many slit-like openings 224 that pierce through the rear surface of this receptacle connector 20. This grounding member 22 is held by the housing 23, with the connection section 223 of the grounding member being disposed in the through opening 232 of the housing 23.

Figure 3:
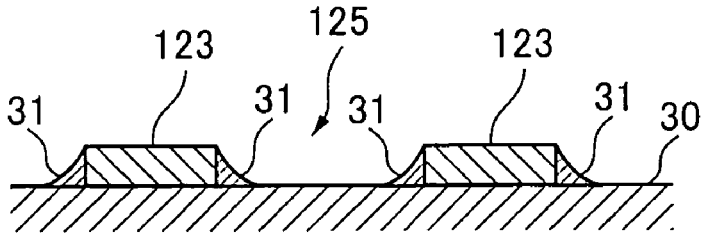
FIG. 3 is a schematic sectional view of a connection section of a grounding member soldered to a substrate.

FIG. 3 is a schematic sectional view of a connection section of a grounding member soldered to a substrate.

Both of the connectors 10, 20 of FIGS. 1 and 2 have grounding members 12, 22, and slit-like openings 125, 224 that pierce through the rear surface are formed in the connection sections 123, 223 of these grounding members 12, 22.

By using the grounding member 12 of the plug connector 10 shown in FIG. 1 as a representative, FIG. 3 shows one of the many openings 125 formed in the connection section 123 of the grounding member 12 and the portions on both sides of the opening 125 in the connection section 123 of the grounding member 12.

The connection section 123 of this grounding member 12 is soldered to a substrate 30 with a solder 31 and surface mounted on the substrate. At this time, as shown in FIG. 3, the peripheral edge parts of the opening 125 are soldered to the substrate 30 with the solder 31.

Because in this manner many openings 125, 224 are provided in the grounding member 12 (the same applies to the grounding member 22 of the receptacle connector 20 shown in FIG. 2), the edges of these many openings 125, 224 are soldered and soldering is performed strongly and securely as a whole. Also, because the openings 125, 224 are through ones and are provided in the through openings 133, 232 provided in the housings 13, 23, it is possible to visually check the condition of soldering of the connection sections 123, 223 of the grounding members 12, 22 and hence the reliability of soldering can be increased.

Figure 4:
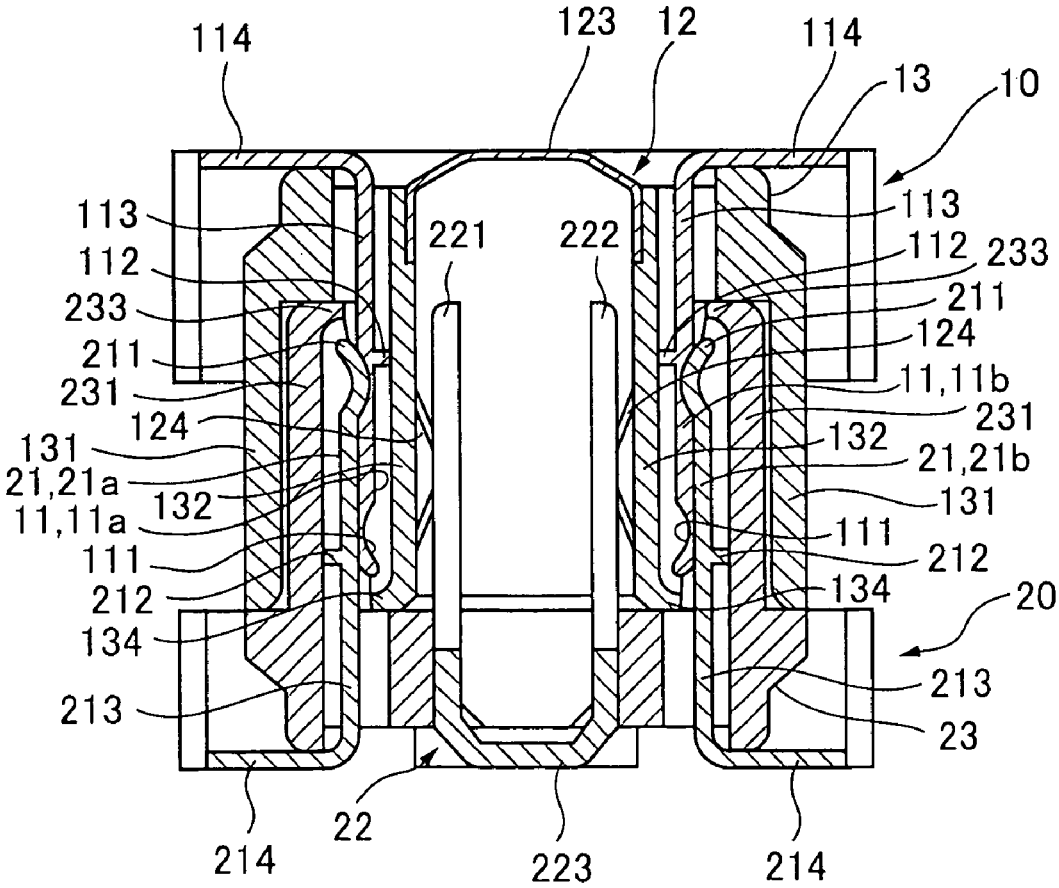
FIG. 4 is a sectional view that shows the fitting condition of the plug connector shown in FIG. 1 and the receptacle connector shown in FIG. 2.
Figure 5:
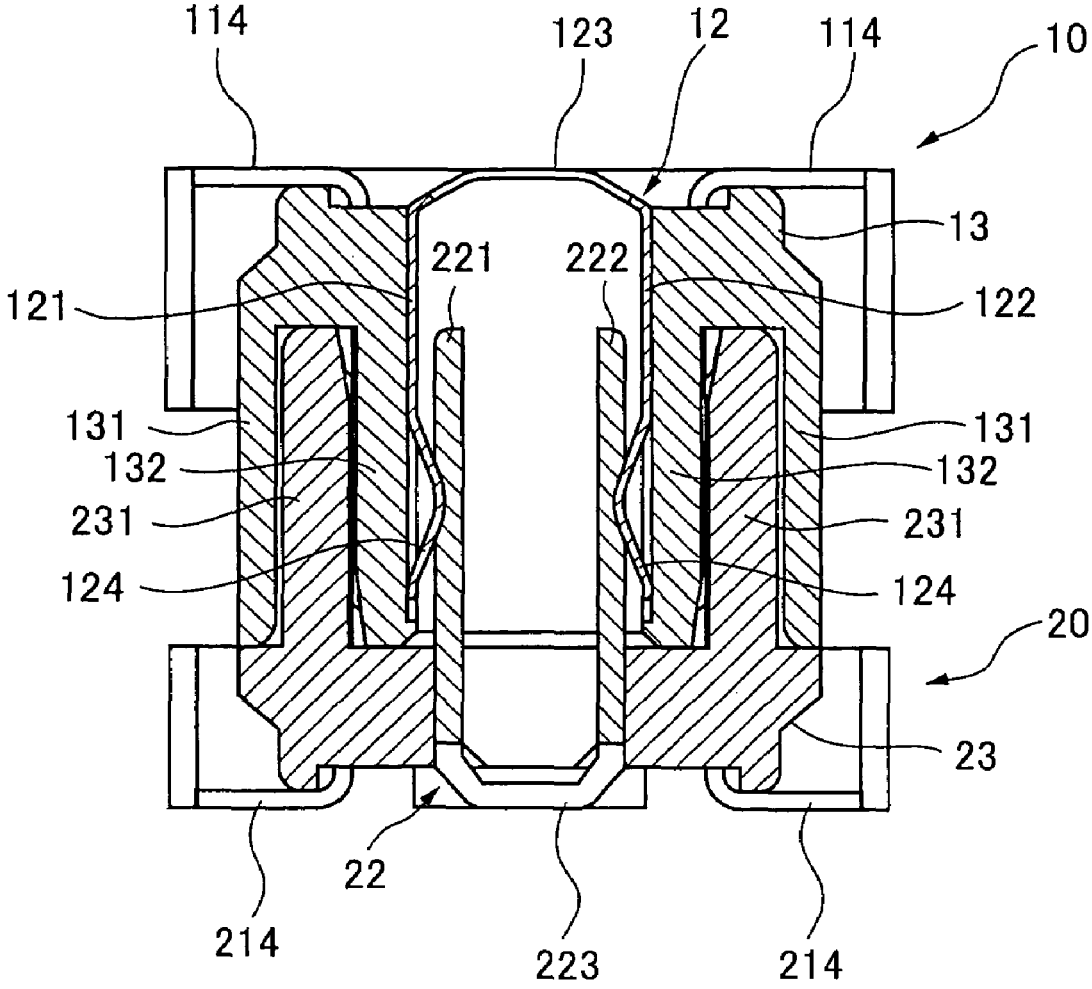
FIG. 5 is a sectional view that shows the fitting condition of the plug connector shown in FIG. 1 and the receptacle connector shown in FIG. 2.

FIGS. 4 and 5 are each a sectional view that shows the fitting condition of the plug connector 10 shown in FIG. 1 and the receptacle connector 20 shown in FIG. 2. FIG. 4 shows the receptacle connector 20 of FIG. 2 sectioned along the arrow X—X and the plug connector 10 of FIG. 1 sectioned in the corresponding place, and FIG. 5 shows the receptacle connector 20 of FIG. 2 sectioned along the arrow Y—Y and the plug connector 10 of FIG. 1 sectioned in the corresponding place.

Incidentally, in FIG. 4, the contact section 111 of the signal contact 11 of the plug connector 10 and the contact section 211 of the signal contact 21 of the receptacle connector 20 are drawn in such a manner that they bite into the mating contact. However, this shows the positions of the contact sections 111, 211 of the signal contacts 11, 21 of the plug connector 10 and receptacle connector 20 before engagement. In reality, however, these contact sections interfere with the mating contact upon engagement and become deflected, with the result that the contact sections come into contact with the mating contact with a prescribed contact pressure and are kept in an electrically conducting state.

Also, in FIG. 4, a grounding contact 124 of the grounding member 12 of the plug connector 10 is drawn in such a manner that part of the grounding contact 124 are hidden behind the first grounding plate 221 and second grounding plate 222 of the grounding member 22 of the receptacle contact 20 and in FIG. 5, the grounding contact 124 bites into the first grounding plate 221 and second grounding plate 222. However, this is also for the same reason as why the contact sections 111, 211 of the above signal contacts are drawn so as to bite into the mating contact. In actuality, however, upon engagement the grounding contact 124 interferes with the first grounding plate 221 and the second grounding plate 222 and is elastically deformed, with the result that the grounding contact 124 comes into contact with the first grounding plate 221 and the second grounding plate 222, with a prescribed contact pressure kept, and that the glands of the plug connector 10 and receptacle connector 20 become connected to each other.

As is apparent from FIGS. 4 and 5, a gland wall constituted by the first grounding plate 121, 221 is formed in a position close to one signal contact row 11*a*, 21*a* and a gland wall constituted by the second grounding plate 122, 222 is formed in a position close to the other signal contact row 11*b*, 21*b*. As a result of this, crosstalks are suppressed, providing a structure suitable for high-speed signal transmission.

The description related to FIGS. 4 and 5 is stopped here temporarily and the structure of the signal contacts 11, 21 themselves will be described.

Figure 6:
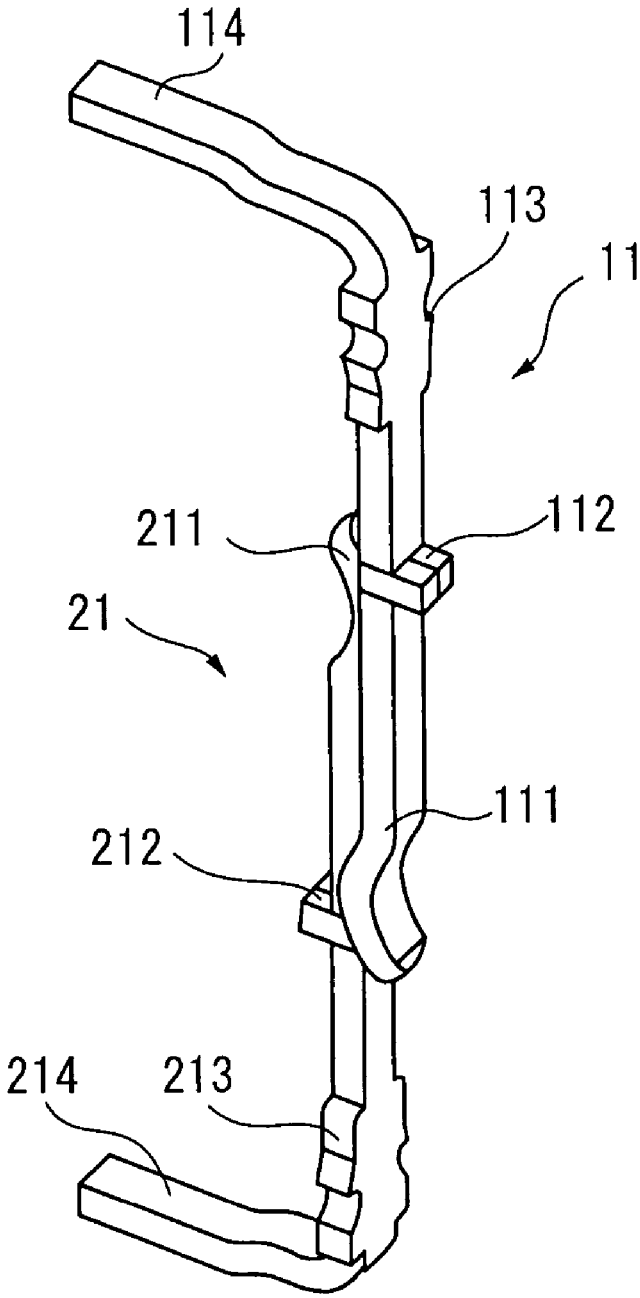
FIG. 6 is a perspective view that shows signal contacts of a plug connector and a receptacle connector.

FIG. 6 is a perspective view that shows signal contacts of a plug connector and a receptacle connector.

As shown in FIG. 6, in the signal contacts 11, 21 are formed the contact sections 111, 211, convexities 112, 212, press fitted sections 113, 213 and terminal sections 114, 214.

When the plug connector 10 (refer to FIGS. 1, 4 and 5) and the receptacle connector 20 (refer to FIGS. 2, 4 and 5) become engaged with each other, the contact sections 111, 211 interfere with the mating connector, are elastically deformed, come into contact with the mating contact with a prescribed contact pressure, and are electrically connected with the mating contact. The surface of the contact section 111, 211 that comes into contact with the mating contact is formed from a surface of a flat metal plate (what is called a roll surface). This surface is a smooth surface, which contributes to a decrease in an insertion/removing force and high contact reliability.

As shown in FIG. 4, the convexities 112, 212 abut against the outer side of the inner wall 132 of the housing 13 of the plug connector 10 and the inner side of the outer wall 231 of the housing 23 of the receptacle connector 20 to thereby keep the contact sections 111, 211 from the inner wall 132 and the outer wall 231 in a spaced condition.

The contact sections 111, 211 are formed so as to come into contact with the vicinities of the convexities 212, 112 of the mating contact. This is because in the parts where the convexities 212, 112 are formed, the convexities 212, 112 abut against the housing and are fixed in position and the elastic parts that are the contact sections 111, 211 and the inelastic parts near the convexities 212, 112 are in contact with each other with a prescribed contact pressure, with the result that the contact between the two contacts is stable and a positive electrically conducting state is achieved.

Figure 7:
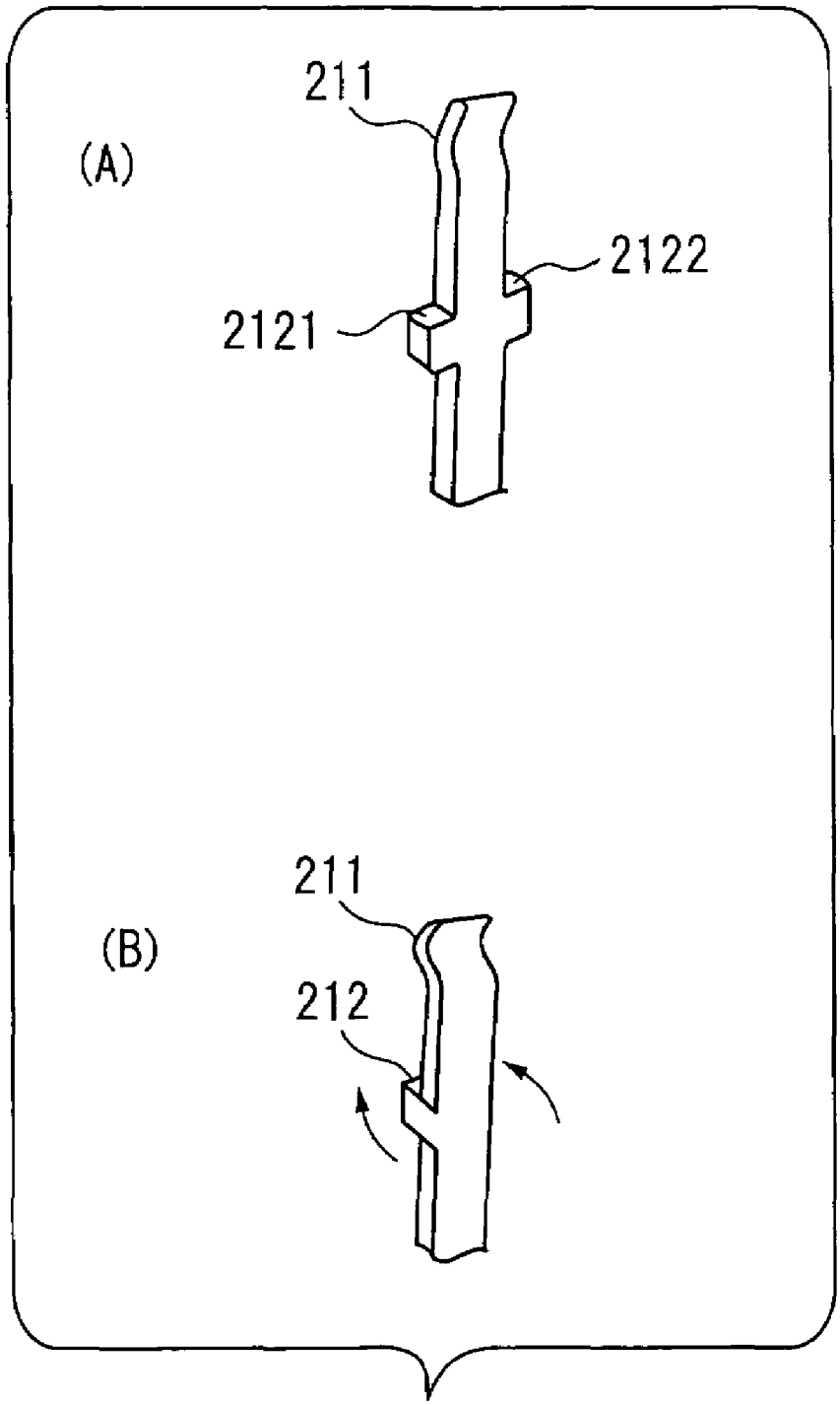
FIG. 7 is an explanatory drawing of a method of forming convexities of a signal contact.
Figure 8:
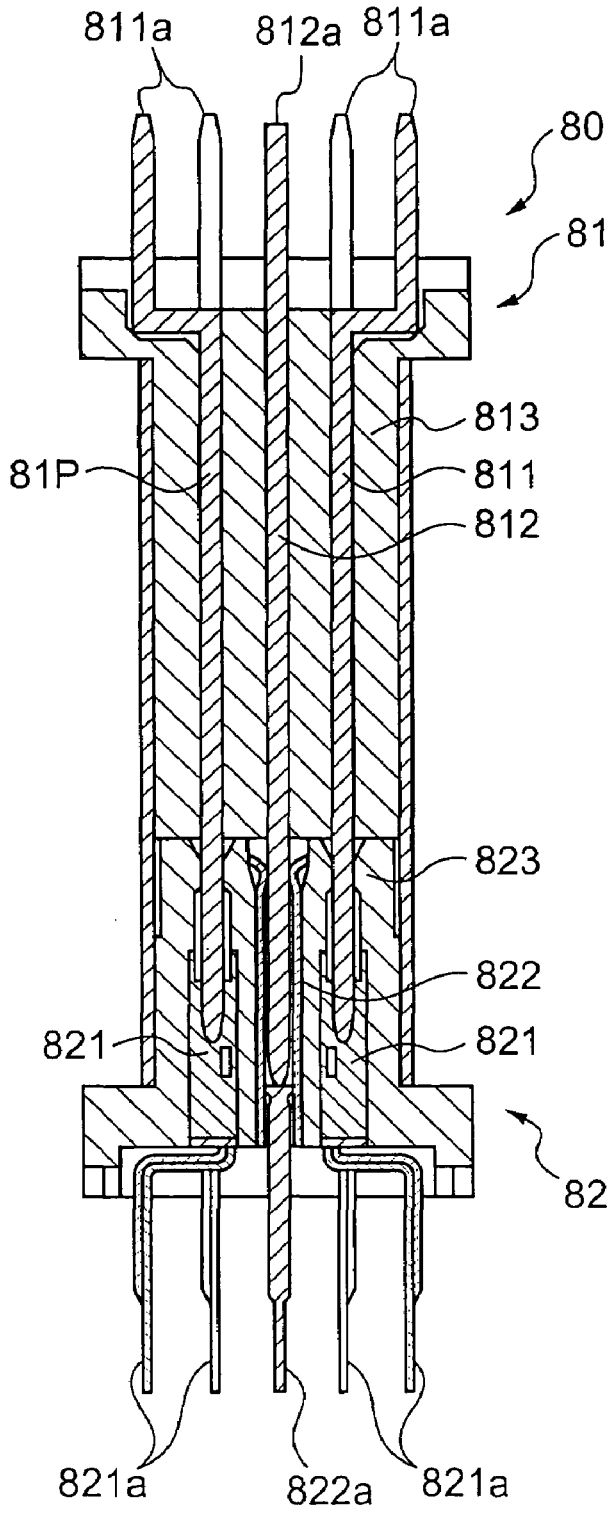
FIG. 8 is a sectional view of an electrical connector assembly disclosed in the Japanese Patent Laid-Open No. 5-135826.
Figure 9:
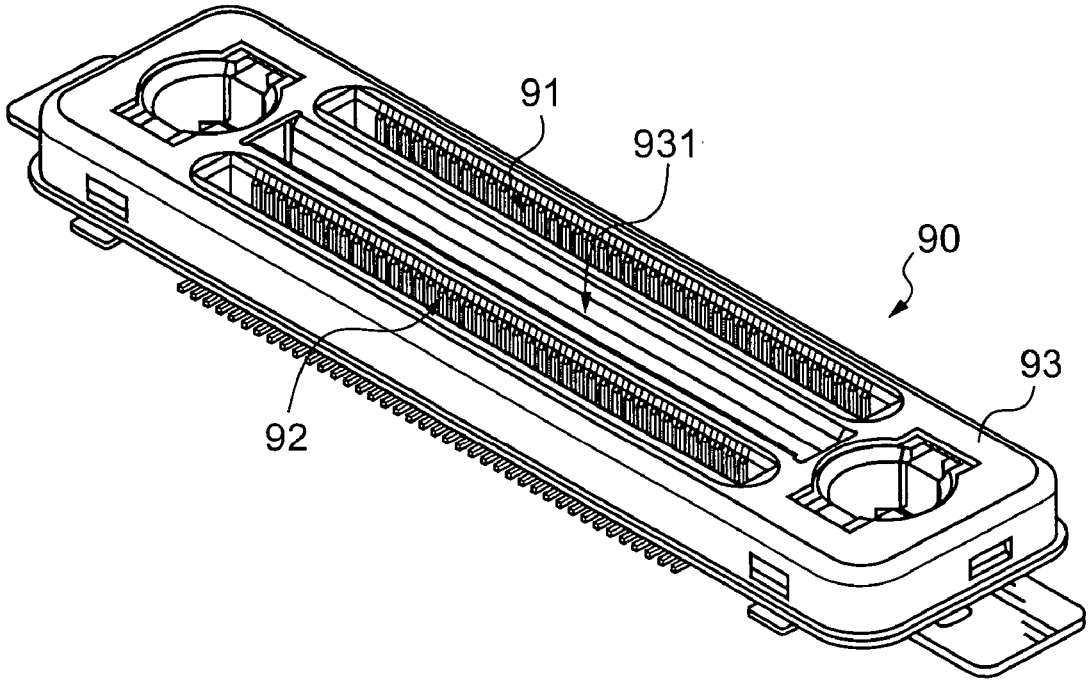
FIG. 9 is an appearance perspective view of an electrical connector assembly disclosed in the National Publication of International Patent Application No. 2000-516028.
Figure 10:
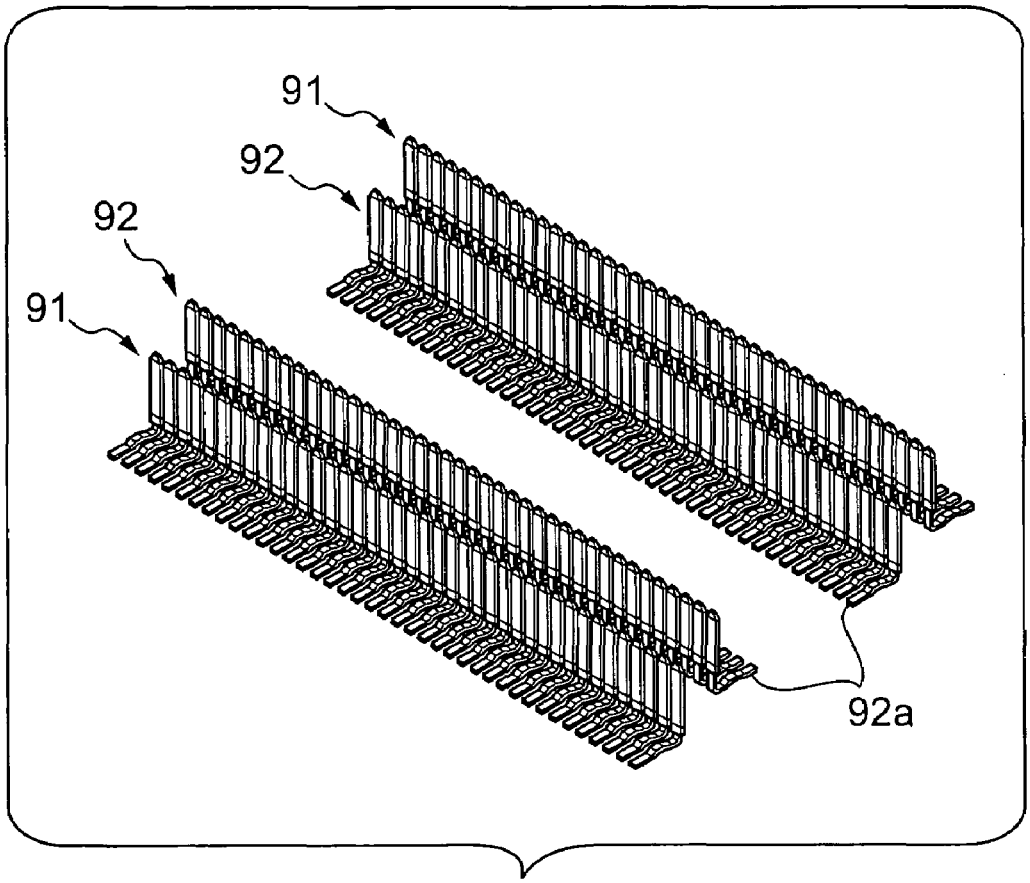
FIG. 10 is a drawing that shows the arrangement of contacts that constitute the electrical connector the appearance of which is shown in FIG. 9.

FIG. 7 is an explanatory drawing of a method of forming convexities of a signal contact. Representatively, a description will be given here of the contact 21 of the receptacle connector 20.

First, as shown in Part (A) of FIG. 7, projecting pieces 2121, 2122 that project in the width direction are formed by blanking a metal plate. After that, these projecting pieces 2121, 2122 that project in the width direction are bent in the arrow direction shown in Part (B) of FIG. 7 and an inward force is applied, whereby the convexity 212 is formed. The same applies also to the convexity 112 of the contact 11 of the plug connector 10.

The press fitted sections 113, 213 of the signal contacts 11, 21 shown in FIG. 6 are parts that are press fitted into the housings 13, 23. The press fitted sections 113, 213 spread in the width direction of the original metal plate, i.e., in the direction perpendicular to the drawing of FIGS. 4 and 5 and are fixed by biting into a wall that faces the direction perpendicular to the drawing of FIGS. 4 and 5 of the housings 13, 23.

The terminal sections 114, 214 of the signal contacts 11, 21 shown in FIG. 6 are to be mounted on a substrate. In the example shown here, the terminal sections 114, 214 have a shape suitable for surface mounting on a substrate.

Again with reference to FIGS. 4 and 5, in particular, FIG. 4, the description will be continued.

In the vicinity of the leading end of the inner wall 132 of the housing 13 of the plug connector 10, i.e., leading end of the contact section 111 of the signal contact 11 of the plug connector 10, there is formed a protective penthouse-like section 134 to protect the leading end of the contact section 111. In the case of the structure of the housing 13 of this plug connector 10, on the outer side of the inner wall 132 there is no projecting portion other than this protective penthouse-like section 134, and it is possible to fabricate this housing 13 by use of a split mold capable of being divided in the vertical direction of FIG. 4. Because the signal contact 11 of this plug connector 10 is provided with the above convexity 112, it is possible to keep the contact section 111 of the signal contact 11 in a condition spaced from the wall of the housing 13 and besides it is ensured that the contact from the contact section of the mating contact can be received in a stable manner by the portion where the convexity 112 of the signal contact 11 is formed.

The same applies also to the receptacle connector 20. That is, in the vicinity of the leading end of the outer wall 231 of the housing 23 of the receptacle connector 20, i.e., leading end of the contact section 211 of the signal contact 21 of the receptacle connector 20, there is formed a protective penthouse-like section 233 to protect the leading end of the contact section 211. In the case of the structure of the housing 23 of this receptacle connector 20, on the inner side of the outer wall 231 there is no projecting portion other than this protective penthouse-like section 233, and it is possible to fabricate this housing 23 by use of a split mold capable of being divided in the vertical direction of FIG. 4. Because the signal contact 21 of this receptacle connector 20 is provided with the above convexity 212, it is possible to keep the contact section 211 of the signal contact 21 in a condition spaced from the wall of the housing 23 and besides it is ensured that the contact from the contact section of the mating contact can be received in a stable manner by the portion where the convexity 212 of the signal contact 21 is formed.

What is claimed is:

1. An electrical connector, comprising:

signal contacts disposed in two rows;

a grounding member disposed between the rows of the signal contacts; and a housing that holds the signal contacts and the grounding member, wherein the grounding member comprises a first grounding plate disposed in the immediate vicinity of one signal contact row, a second grounding plate disposed in the immediate vicinity of the other signal contact row, and a connection section that connects the first and second grounding plates together for being surface mounted on a substrate on which the electrical connector is mounted, the grounding member being in the form of the letter Π as viewed from the side, and wherein the housing has a through opening between the first and second grounding plates so that the connection section can be visually checked.

2. An electrical connector assembly, comprising:

a first connector and a second connector, each of the first and second connectors having signal contacts disposed in two rows, a grounding member disposed between the rows of signal contacts and a housing that holds the signal contacts and grounding member and being engaged with each other, wherein each of the grounding members comprises a first grounding plate disposed in the immediate vicinity of one signal contact row, a second grounding plate disposed in the immediate vicinity of the other signal contact row, and a connection section that connects the first and second grounding plates together for being surface mounted on a substrate on which the electrical connector is mounted, the grounding members being in the form of the letter Π as viewed from the side, and wherein each of the housings has a through opening between the first and second grounding plates so that the connection section can be visually checked.

3. The electrical connector assembly according to claim 2, wherein the grounding plate of the first connector is positioned inward compared to the grounding plate of the second connector and has relatively large rigidity.

* * * * *